US007184681B2

(12) United States Patent
Funakoshi

(10) Patent No.: US 7,184,681 B2
(45) Date of Patent: Feb. 27, 2007

(54) IMAGE FORMING APPARATUS WITH INTEGRAL RECORDING MATERIAL SUPPLY AND POWER SUPPLY UNITS

(75) Inventor: Masahiro Funakoshi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/928,124

(22) Filed: Aug. 30, 2004

(65) Prior Publication Data

US 2005/0025515 A1 Feb. 3, 2005

Related U.S. Application Data

(62) Division of application No. 10/600,703, filed on Jun. 23, 2003, now Pat. No. 6,836,628.

(30) Foreign Application Priority Data

Jul. 4, 2002 (JP) ..... 2002-196406

(51) Int. Cl.
*G03G 15/00* (2006.01)

(52) U.S. Cl. ..... 399/88; 399/107; 399/110

(58) Field of Classification Search ..... 399/107, 399/110, 125, 88, 37, 111; 347/138, 152
See application file for complete search history.

(56) References Cited

U.S. PATENT DOCUMENTS

| | | | | |
|---|---|---|---|---|
| 5,512,928 | A | 4/1996 | Kato et al. | 347/138 |
| 6,088,553 | A | 7/2000 | Kuwata et al. | 399/107 |
| 6,144,468 | A | 11/2000 | Watanabe | 358/496 |
| 6,314,267 | B1 | 11/2001 | Kida | 399/405 |
| 2002/0168197 | A1 | 11/2002 | Kitozaki | 399/88 |
| 2003/0118367 | A1 | 6/2003 | Omata et al. | 399/110 |

FOREIGN PATENT DOCUMENTS

| | | |
|---|---|---|
| JP | 1-133150 | 9/1989 |
| JP | 4-84148 | 3/1992 |
| JP | 4-328585 | 11/1992 |
| JP | 7-132664 | 5/1995 |
| JP | 11-177249 | 7/1999 |
| JP | 2000-177908 | 6/2000 |
| JP | 2002-171372 | 6/2002 |
| JP | 2002-278194 | 9/2002 |

*Primary Examiner*—Sophia S. Chen
(74) *Attorney, Agent, or Firm*—Fitzpatrick, Cella, Harper & Scinto

(57) ABSTRACT

It is an object of the present invention to provide an image forming apparatus with a small installation area. In order to attain this object, an image forming apparatus in accordance with the present invention includes: a recording material unit which stores recording materials; an image forming unit which is arranged above the recording material unit and forms an image on the recording material supplied from the recording material unit; and a power supply unit for supplying electric power to the image forming apparatus, in which the power supply unit is constituted as a unit integral with the recording material unit and is arranged below the image forming unit.

5 Claims, 7 Drawing Sheets

IMAGE FORMING APPARATUS WITH INTEGRAL RECORDING MATERIAL SUPPLY AND POWER SUPPLY UNITS

This is a divisional application of application Ser. No. 10/600,703, filed Jun. 23, 2003.

BACKGROUND OF THE INVENTION

1. Field of the Invention

The present invention relates to an image forming apparatus such as a copier or a printer which uses an electrostatic recording process, an electrophotographic process, or the like.

2. Related Background Art

Conventionally, an image forming apparatus such as a printer, a copier, or a facsimile is provided with a recording material supplying portion and an image forming portion. The recording material supplying portion stores a large number of sheet-like recording materials (mediums on which images are formed) and separates and conveys the recording materials one by one. On the other hand, the image forming portion forms an image with a toner or ink on a surface of the recording material supplied by the recording material supplying portion.

In such an apparatus, the recording material supplying portion for supplying a recording material to the image forming portion is constituted as a unit having a plurality of cassettes and is arranged below the image forming portion, whereby a width of the apparatus is reduced.

However, since a size of the recording material is smaller than the area of the base of the image forming portion, there is still left room for reduction of a space.

SUMMARY OF THE INVENTION

It is an object of the present invention to provide an image forming apparatus with a small installation area.

It is another object of the present invention to provide an image forming apparatus including:

a recording material unit which stores recording materials;

an image forming unit which is arranged above the recording material unit and forms an image on the recording material supplied from the recording material unit; and a power supply unit for supplying electric power to the image forming apparatus, in which the power supply unit is constituted as a unit integral with the recording material unit and is arranged below the image forming unit.

Further objects of the present invention will be apparent in the following description.

DETAILED DESCRIPTION OF THE PREFERRED EMBODIMENTS

An embodiment of the present invention will be described with reference to the accompanying drawings.

FIGS. 1 to 7 show an image forming apparatus according to the embodiment of the present invention.

Figure 1:
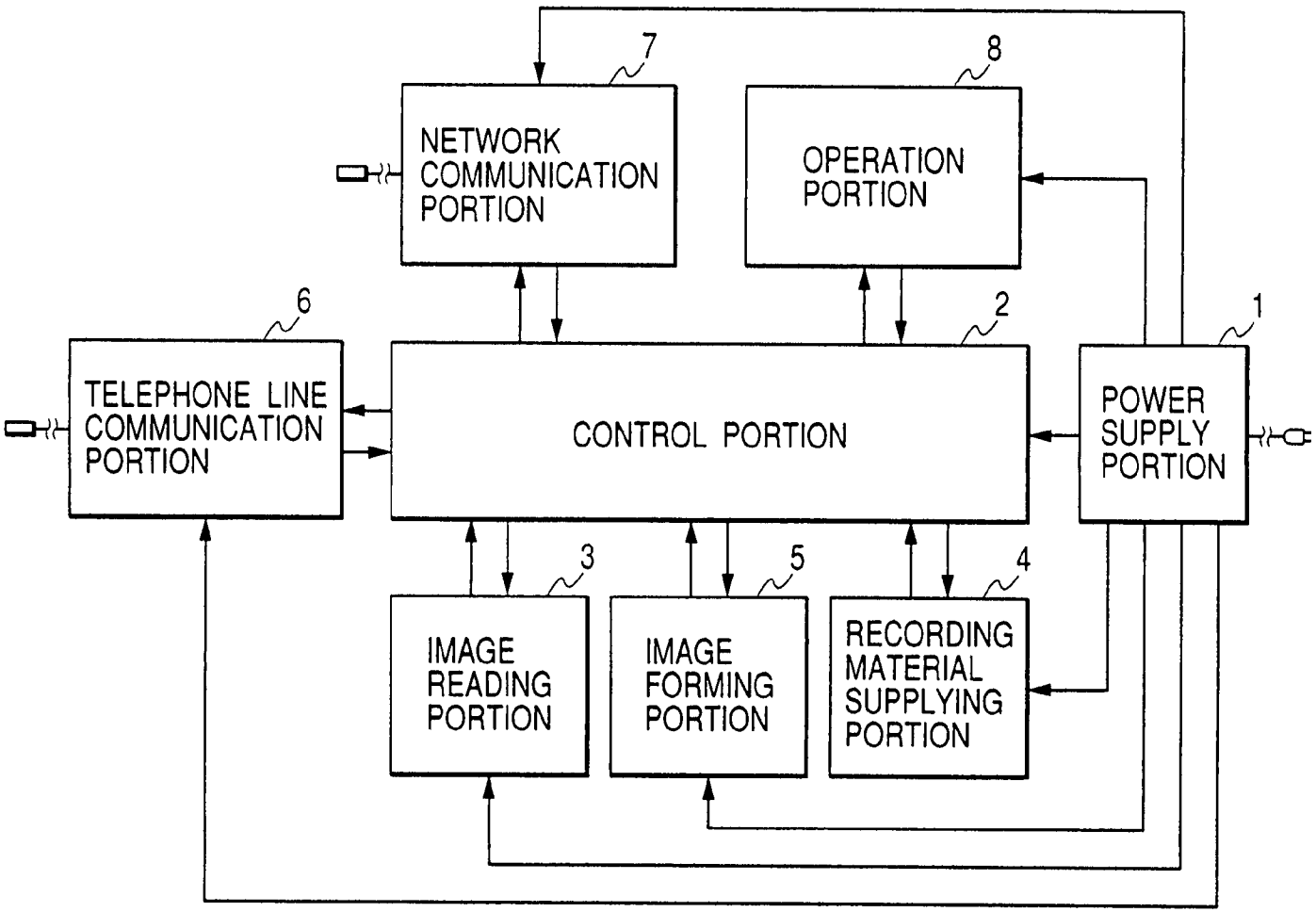
FIG. 1 is a block diagram showing a system configuration of an image forming apparatus.
Figure 2:
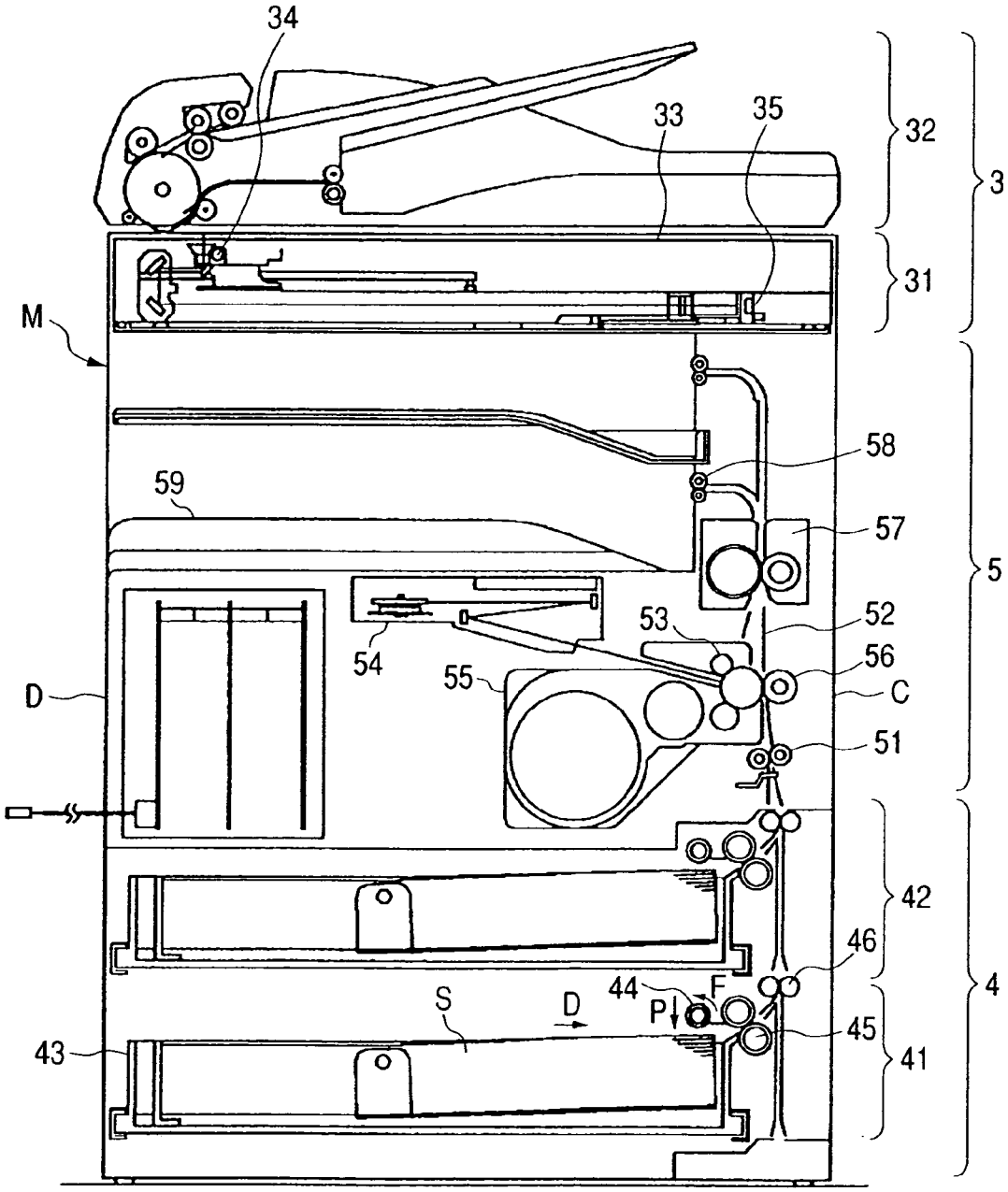
FIG. 2 is a front longitudinal sectional view showing an internal structure of the image forming apparatus.
Figure 3:
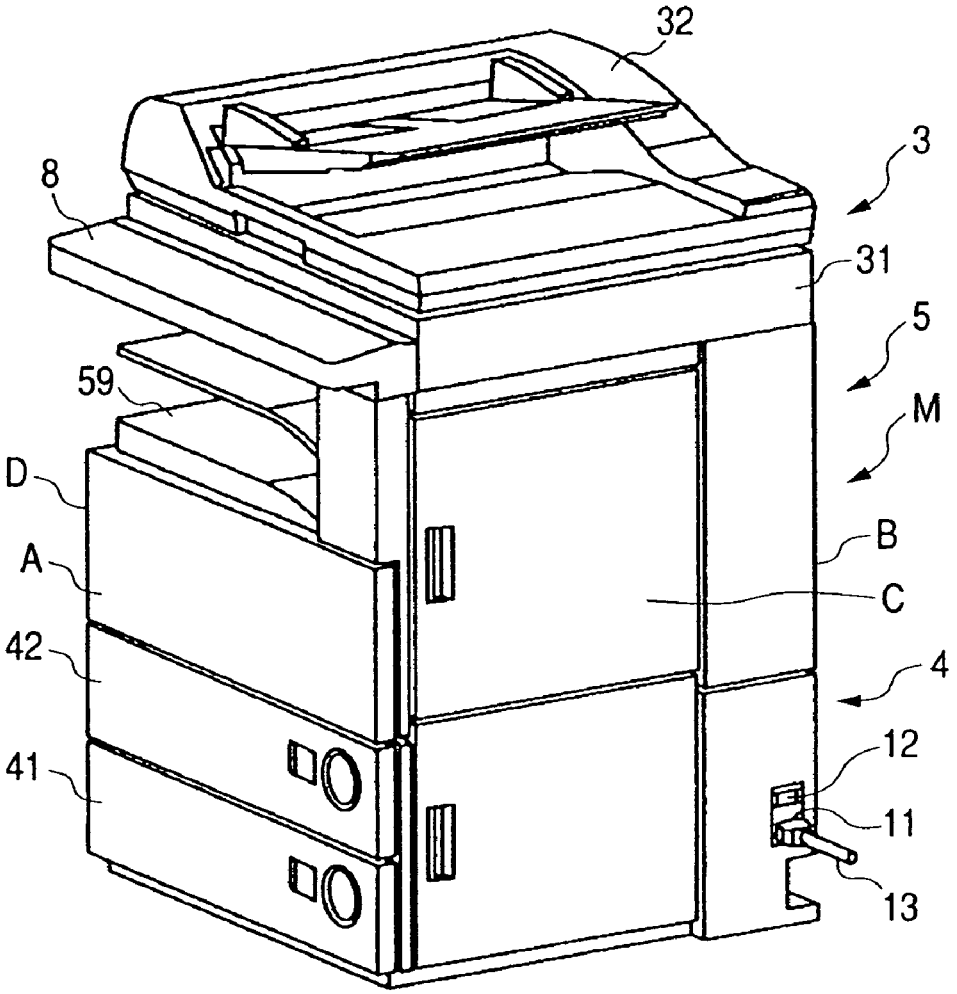
FIG. 3 is an external perspective view of the image forming apparatus viewed from a position above on a front surface side and a right side surface side of the image forming apparatus.
Figure 4:
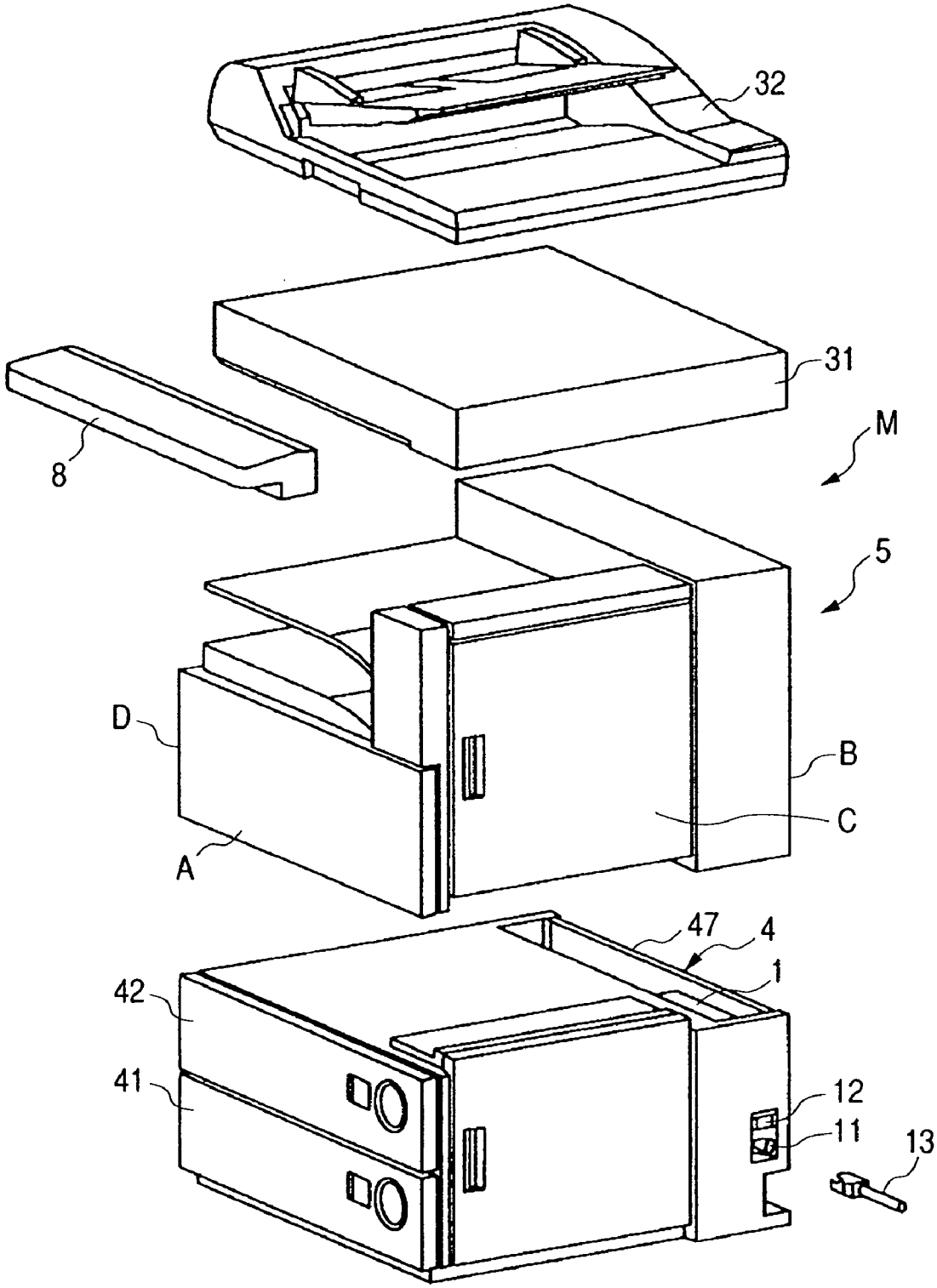
FIG. 4 is a disassembled perspective view of the image forming apparatus viewed from the same direction as FIG. 3.
Figure 5:
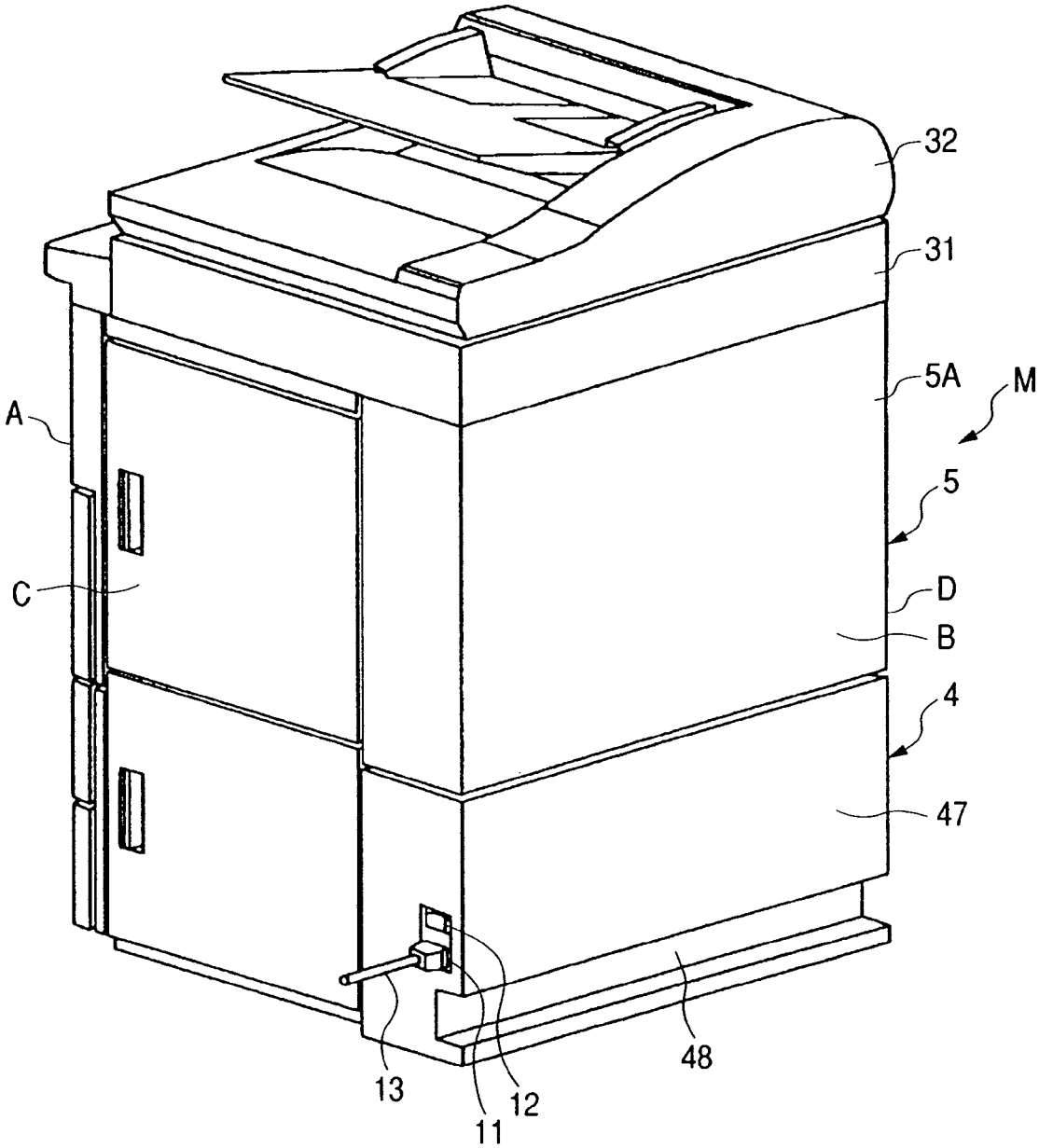
FIG. 5 is an external perspective view of the image forming apparatus viewed from a position above on a rear surface side and a right side surface side of the image forming apparatus.
Figure 6:
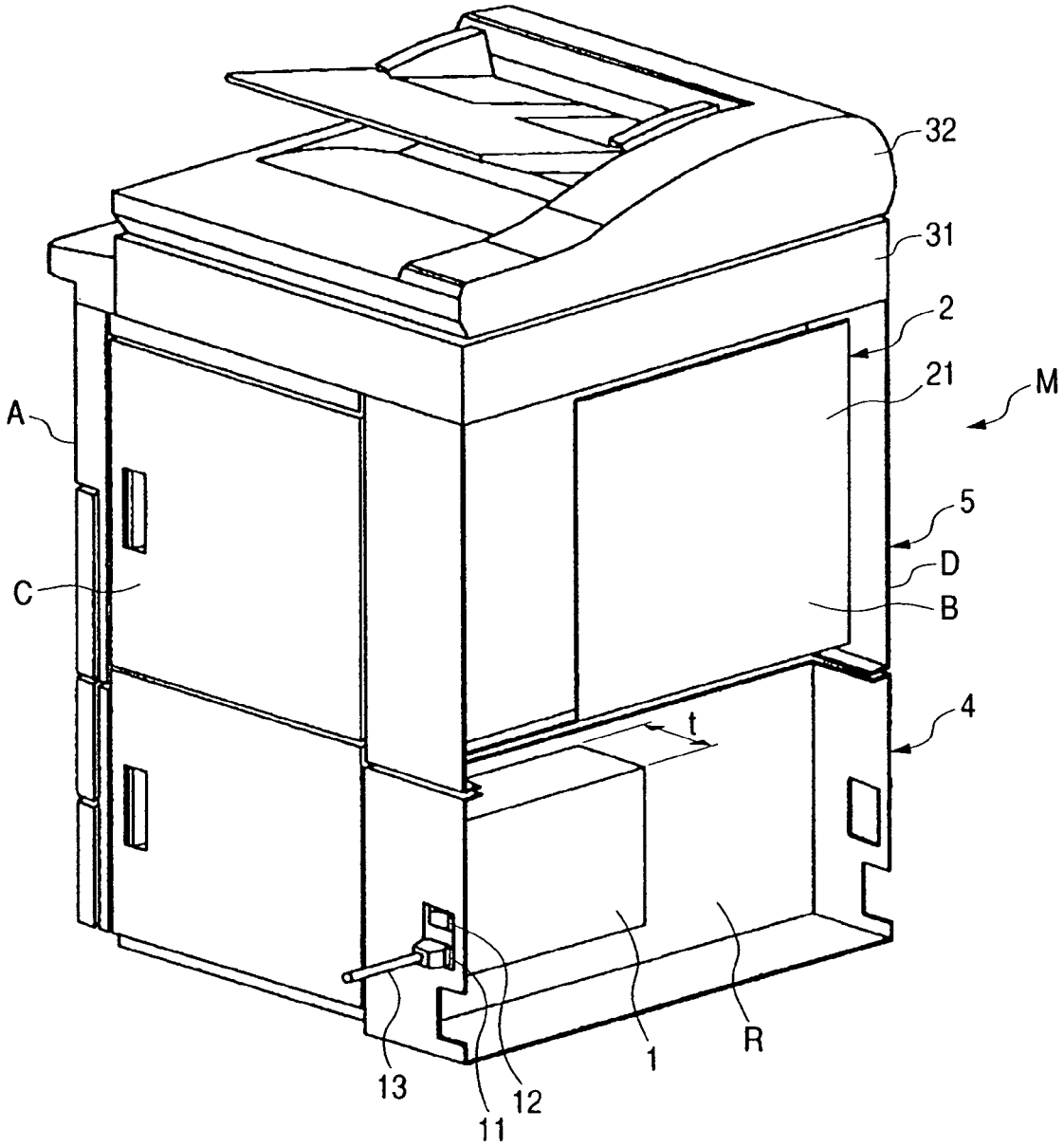
FIG. 6 is a view showing a state in which a rear cover is removed from the state shown in FIG. 5.
Figure 7:
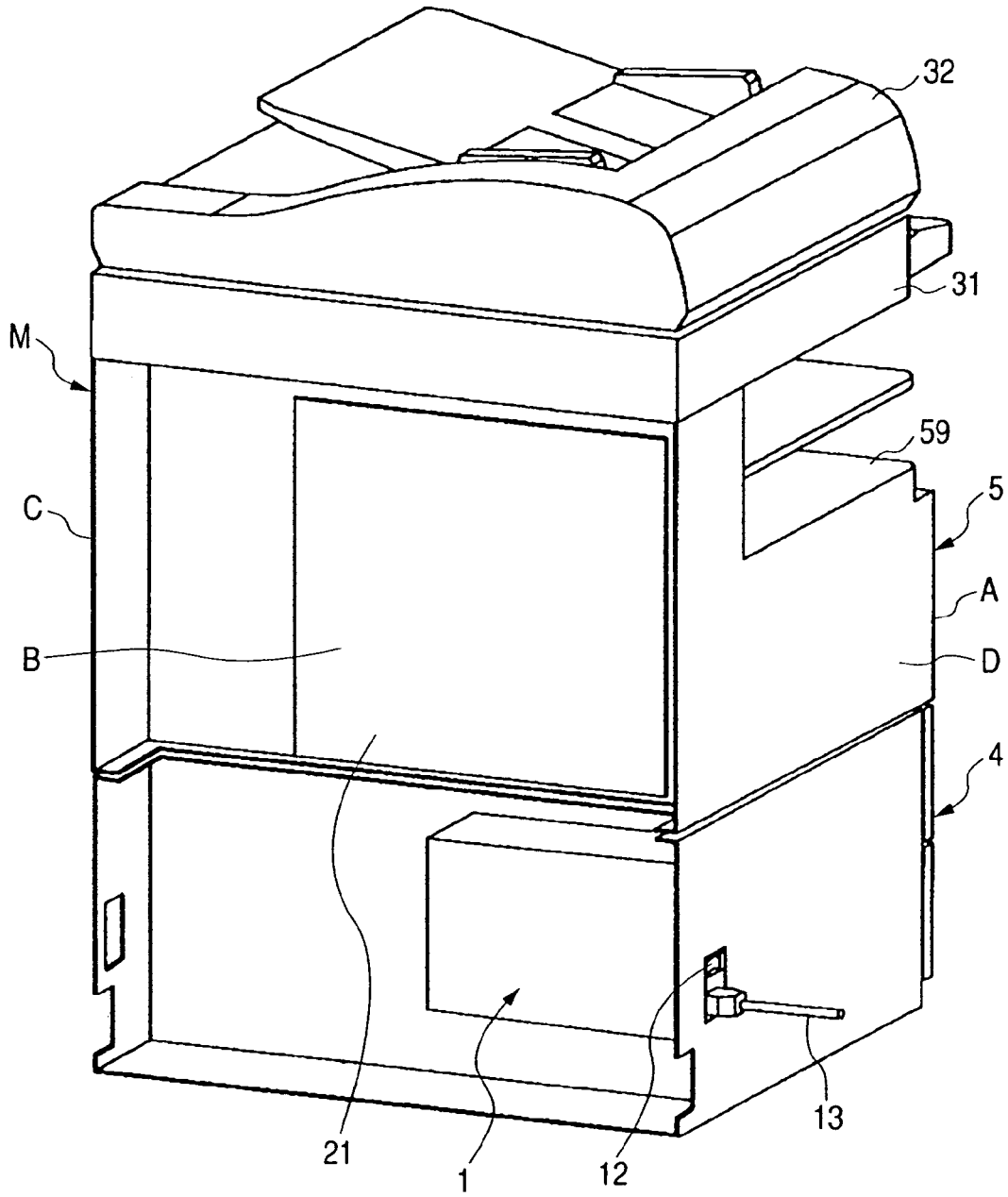
FIG. 7 is a perspective view of a rear surface side of the image forming apparatus showing a state in which a power supply portion is arranged on a left side surface side of the image forming apparatus.
Figure 2:
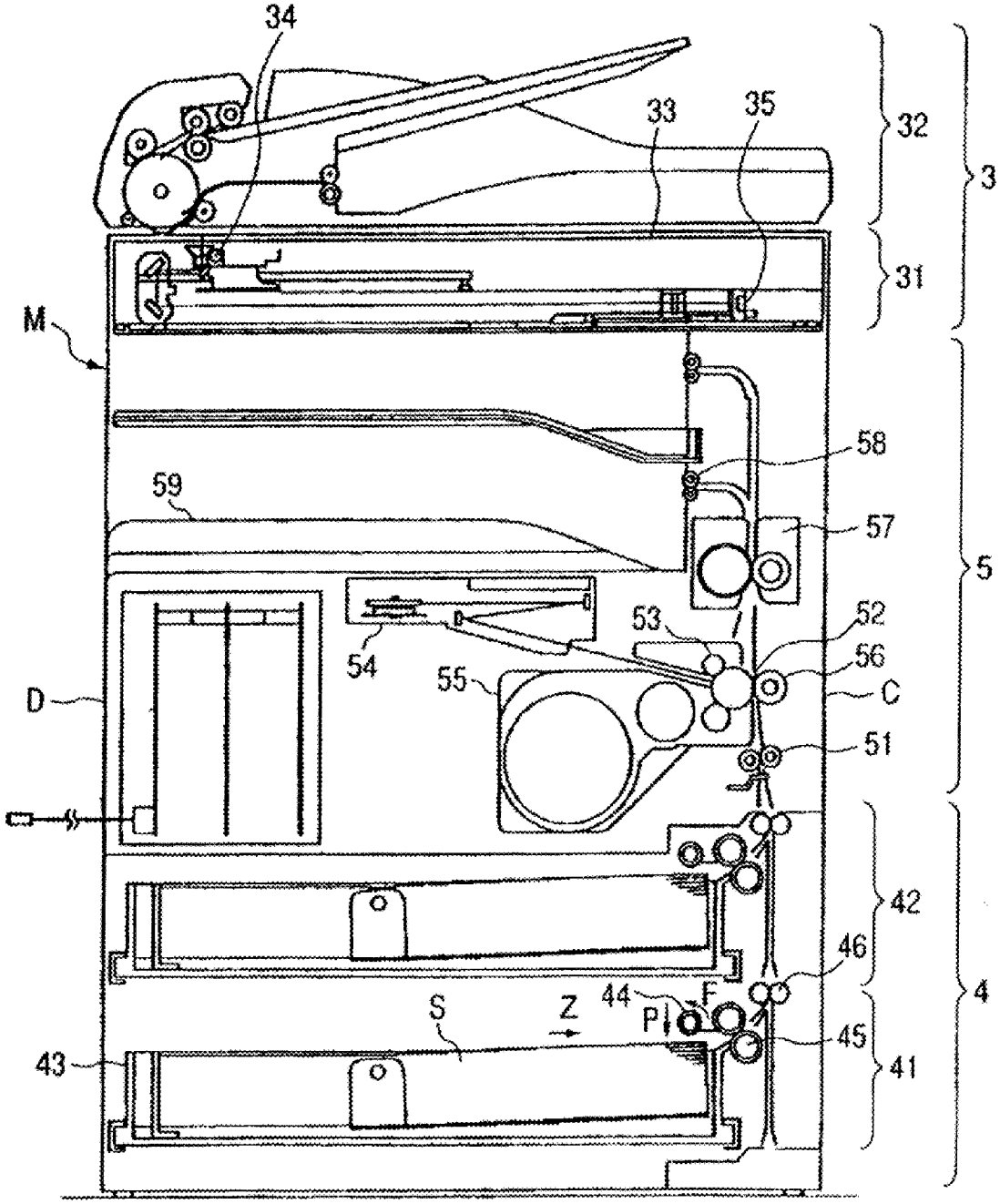

Here, FIG. 1 is a block diagram showing a system configuration of the image forming apparatus in accordance with this embodiment, FIG. 2 is a front longitudinal sectional view showing an internal structure of the image forming apparatus, FIG. 3 is an external perspective view showing a combined state of the image forming apparatus viewed from a front surface side thereof, FIG. 4 is a disassembled perspective view of a module configuration of the image forming apparatus viewed from the front surface side thereof, FIG. 5 is an external perspective view showing a combined state of the image forming apparatus viewed from a rear surface side thereof, FIG. 6 is a perspective view showing a power supply arrangement of the image forming apparatus viewed from the rear surface side thereof, and FIG. 7 is a perspective view from the rear surface side showing a state in which the left and right of the power supply arrangement are reversed from the state of FIG. 6.

First, the system configuration of the entire image forming apparatus will be described briefly with reference to FIG. 1.

As shown in the figure, the image forming apparatus is provided with a control portion 2 which electrically controls the entire image forming apparatus. To this control portion 2, a power supply portion 1, an image reading portion 3, a recording material supplying portion 4, an image forming portion 5, a telephone line communication portion 6, a network communication portion 7, an operation portion 8, and the like are connected.

Among these portions, the power supply portion 1 is one of electrical system units and constitutes a power supply unit. Note that, in this embodiment, the power supply portion 1 is a unit having a largest weight among the electrical system units as well as among units including units other than the electrical system units disposed in the image forming apparatus. The power supply portion 1 is connected to a commercial power supply or the like via a wall socket or the like and supplies electric power necessary for operating the respective portions of the image forming apparatus.

The image reading portion 3 applies light to a reading object such as an original and converts a reflected light from the reading object into an electric signal to thereby read the electric signal as image information. The recording material supplying portion 4 stores a large number of sheet-like recording materials and separates and conveys the recording materials one by one. The image forming portion 5 forms an image on the sheet-like recording material, which is conveyed from the recording material supplying portion 4, based upon the image information. The control portion 2 is provided with means or the like for subjecting the image information, which is converted into the electric signal in the image reading portion 3, to imaging processing or saving the image information. The telephone line communication portion 6 sends the read image information to another facsimile or the like via a telephone line or the like and receives image information or the like sent from another facsimile or the like. The network communication portion 7 makes connection to a computer network to perform transmission and reception of image information, character information, or the like through the network or remotely controls the image forming apparatus. The operation portion 8 is a portion on which a state of the image forming apparatus is displayed or with which a user performs input or the like for operating the image forming apparatus.

The image forming apparatus constituted as described above is provided with a copying function for outputting the image information, which is read by the image reading portion 3, to a recording material with the image forming portion 5, and can also function as a scanner or a printer for a computer or the like via the network.

Next, an internal structure of the image forming apparatus will be described briefly with reference to FIG. 2.

As shown in the figure, the recording material supplying portion 4 is disposed in the lower part of an image forming apparatus main body M, the image forming portion 5 is disposed in a middle part thereof, and the image reading portion 3 is disposed in an upper part thereof. As described above, the recording material supplying portion 4 stores a large number of recording materials S, on which images are yet to be formed, and separates the recording materials S one by one to convey them toward the image forming portion 5. The image forming portion 5 forms an image on the recording material S conveyed from the recording material supplying portion 4 with the electrophotographic process. The image reading portion 3 reads an image-on an original.

In the recording material supplying portion 4, cassette feeding portions 41 and 42, which are capable of appropriately coping with the recording materials S of various sizes ranging from about a standard A3 size to A5 size, are provided in two stages. In the cassette feeding portion 41, the recording materials S are stored in a cassette 43. In supplying the recording materials S, the cassette 43 is pulled out from the image forming apparatus main body M to a front surface side (surface side in FIG. 2) to place the recording materials S therein. A pickup roller 44, a separation roller 45, and the like are provided in the cassette feeding portion 41. At the time of feeding the recording materials S, the pickup roller 44 falls in a direction of arrow P and is pressed against the uppermost recording material S among the large number of recording materials S stacked in the cassette 43 and, at the same time, rotates in a direction of arrow F, whereby feeding of the recording material S starts. The uppermost recording material S started to be fed is separated from the other recording materials S by the separation roller 45 and, then, conveyed in a direction of arrow Z, conveyed to a registration roller 51 by the conveying roller 46, and stopped once in the registration roller 51.

A drum type electrophotographic photosensitive member (hereinafter referred to as "photosensitive drum") 52 serving as an image bearing member is disposed in the image forming portion 5. The photosensitive drum 52 is driven to rotate counterclockwise in FIG. 2, and a surface thereof is charged uniformly in a predetermined polarity and potential by using a charging roller (a first charging device) 53. The surface of the photosensitive drum 52 after charging is subjected to irradiation of a laser beam, light emission of which is controlled according to image information, by a laser scanner (exposing apparatus) 54. Then, charges on an irradiated part of the surface of the photosensitive drum 52 are removed and an electrostatic latent image is formed thereon. A particulate toner is electrostatically adhered to this electrostatic latent image by a developing apparatus 55, whereby the electrostatic latent image is developed as a toner image.

The toner image formed on the photosensitive drum 52 is transferred onto the surface of the recording material S, which is conveyed from the registration roller 51 at predetermined timing, by a transfer roller (transferring apparatus) 56.

The recording material S having the toner image transferred thereon is conveyed to a fixing apparatus 57, in which the toner image is heated and pressurized to be fixed on the surface of the recording material S. The recording material S having the toner image fixed thereon is discharged onto a sheet discharge tray 59 by a sheet discharge roller 58 with the surface on which the toner image is formed facing downward, so-called facedown.

The image reading portion 3 is provided with a thin flatbed-shaped scanner portion 31, which reads an image with a contact image sensor, and an automatic original feeding portion 32. The flatbed-shaped scanner portion 31 scans an image surface of an original, which is placed on an original stand glass 33, on a side in contact with the original stand glass 33 through an optical system consisting of a mirror and a lens while lighting the image surface with a light source 34, thereby converting an optical image on the image surface into an electric signal with a photoelectrical conversion device such as a CCD 35 or the like. The automatic original feeding portion 32 separates and conveys a plurality of originals one by one and reads the originals using the optical system, the photoelectrical conversion device, and the like of the flatbed-shaped scanner portion 31.

Next, a structure of the image forming apparatus in accordance with this embodiment will be described with reference to FIGS. 3 to 6. Note that, in the image forming apparatus main body M, a front surface A, a rear surface B, a right side surface C, and a left side surface D are defined as shown in FIG. 3.

FIG. 3 is an external perspective view of the entire image forming apparatus looked down from a position diagonally above on the front surface A side and on the right side surface C side of the image forming apparatus. As shown in the figure, in the image forming apparatus, the automatic original feeding portion 32, the flatbed-shaped scanner portion 31, the image forming portion 5, and the recording material supplying portion 4 are arranged in order from the top. The operation portion 8 is arranged in an upper position on the front surface A side of the image forming apparatus main body M and on the front side (front surface side) of the flatbed-shaped scanner portion 31 taking into account operability of a user.

FIG. 4 is an external perspective view which, in order to represent that the respective portions constituting the image forming apparatus of FIG. 3 are constituted as modules, shows the image forming apparatus, which is in a state in which the respective modules are separated to be spatially apart from each other, viewed from a position diagonally above on the front surface A side and on the right side surface C side of the image forming apparatus. The automatic original feeding portion 32, the flatbed-shaped scanner portion 31, the image forming portion 5, and the recording material supplying portion 4 are constituted as modules and stacked in order from the top.

FIG. 5 is an external perspective view of the image forming apparatus of FIG. 3 viewed from a position diagonally above on the rear surface B side and on the right side surface C side. A rear cover 5A is attached to the rear surface B side of the image forming portion 5 and a rear cover 47 is attached to the rear surface B side of the recording material supplying portion 4.

FIG. 6 is a perspective view of the image forming apparatus of FIG. 3, which is in a state in which the rear covers 5A and 47 are removed from the state in FIG. 5, viewed from a position diagonally above on the rear surface B side and on the right side surface C side of the image forming apparatus. A control substrate 21 including a most important electric circuit of the control portion 2 is arranged on the inner side of the rear cover 5A. In addition, a power supply cord 13 connecting the power supply portion 1 and a commercial power supply or the like outside the image forming apparatus is arranged in a lower part in a rear part of the right side surface C of the image forming apparatus main body M.

The power supply portion 1 is a box type unit formed in a rectangular parallelepiped shape and is formed such that a thickness (dimension in a depth direction) t is smaller than a height (dimension in a vertical direction) and a width (dimension in a horizontal direction). Consequently, a large degree of freedom concerning arrangement can be secured with respect to a housing space R which is provided on the rear surface B side of the recording material supplying portion 4 and has dimensions relatively large in the vertical direction and the horizontal direction and relatively small in the depth direction. A transformer for transforming a voltage, a rectifying circuit for transforming a commercial power supply of an alternating current into a direct current, a security circuit for the case in which overcurrent flows, and the like are incorporated in the power supply portion 1. In addition, the power supply portion 1 is provided with an inlet 11 for connecting the power supply portion 1 with the power supply cord 13 and a switch 12 for electrically connecting and disconnecting a commercial power supply outside the image forming apparatus and the power supply portion 1 in the image forming apparatus. Since the power supply portion 1 is also provided with a radiator plate for radiating heat of the transformer and the incorporated devices, a weight of the power supply portion 1 is greater than that of other electrical system units. That is, in this embodiment, the power supply portion 1 is an electrical system unit having a greatest weight among a plurality of electrical system units (not shown) in the image forming apparatus. Note that, in this embodiment, the power supply portion 1 is constituted as a unit having a greatest weight not only among the electrical system units but also among electrical system units including other units. The power supply portion 1, the control substrate 21, other electrical system units (not shown), and electrical components are directly or indirectly connected by electric wires.

In addition, as shown in FIG. 5, a groove 48 in the horizontal direction is provided in a lower part of the rear cover 47. The power supply cord 13 sticking out from the right side surface C side of the image forming apparatus main body M can be drawn around through this groove 48 to be pulled out on the left side surface D side of the image forming apparatus main body M.

As shown in FIG. 7, the image forming apparatus in accordance with this embodiment can also be attached to the left side surface D side on the rear surface B side of the recording material supplying portion 4 in a state in which the left and right of the power supply portion 1 are reversed.

As shown in FIG. 4, the image forming apparatus in accordance with this embodiment is constituted as a whole by stacking the recording material supplying portion 4, the image forming portion 5, the flatbed-shaped scanner 31, and the automatic original feeding portion 32, which are constituted as modules individually, in order from the bottom side.

Consequently, since the combination of the recording material supplying portion 4 and the image forming portion 5 can be changed easily, development of an image forming apparatus can be performed efficiently on a developer side. On the other hand, since the recording material supplying portion 4 and the image forming portion 5 can be combined appropriately as required, a user on a user side can establish a most suitable image forming apparatus according to a state of use.

In addition, since the recording material supplying portion 4 and the image forming portion 5 are easily separated, disassembly and dismantling can be performed efficiently when the image forming apparatus is recycled.

Moreover, since the power supply portion 1, which is an electrical system unit having a largest weight among the units constituting the image forming apparatus, is arranged in the recording material supplying portion 4 located in the lowermost part, the entire image forming apparatus has a low center of gravity. Thus, there is an effect that a balance of the image forming apparatus with respect to an overturning direction thereof is improved, and the image forming apparatus becomes less likely to overturn.

Further, since the power supply portion 1 having a large caloric value is arranged apart from the other electrical system units, it becomes possible to reduce influence of heat exerted upon the other electrical system units.

As described above, according to the present invention, since a recording material supplying portion and an image forming portion are constituted as separate bodies and combined, development of an image forming apparatus can be performed efficiently on a developer side and, on the other hand, the recording material supplying portion and the image forming portion can be combined appropriately as required on a user side. Thus, an apparatus structure most suitable for a state of use can be established. In addition, disassembly and dismantling in recycling the image forming apparatus are facilitated. Moreover, since a unit having a largest weight among units is arranged in the recording material supplying portion arranged in a lower part, the entire image forming apparatus has a low center of gravity. Thus, balance of the image forming apparatus with respect to an overturning direction thereof is improved, and the image forming apparatus becomes less likely to overturn.

The embodiment of the present invention has been described. However, the present invention is not limited to the embodiment, and various modifications are possible within the technical idea of the present invention.

What is claimed is:

1. A recording material unit mounted to an image forming unit for forming an image on a recording material, said recording material unit being mounted to the image forming unit in order to supply the recording material to the image forming unit, comprising:

a recording material storage portion which stores the recording material to be supplied to the image forming unit;

a combining portion capable of being combined with a plurality of various image forming units; and a power supply unit, which is mounted on an inside of said recording material unit, for supply of electrical power to the combined image forming unit, wherein a plurality of opposed surfaces of said recording material unit are respectively provided with a hole in order to electrically connect said power supply unit.

2. A recording material unit according to claim 1, wherein the image forming unit is mounted above said recording material unit.

3. A recording material unit according to claim 1, wherein an electrical substrate unit, which controls operation of the image forming unit mounted to said recording material unit, is mounted to the image forming unit.

4. A recording material unit according to claim 3, wherein said power supply unit is heavier than the electrical substrate unit.

5. A recording material unit according to claim 1, wherein a reader unit, which reads an image on an original to be copied, is arranged above the image forming unit.

* * * * *

UNITED STATES PATENT AND TRADEMARK OFFICE

CERTIFICATE OF CORRECTION

PATENT NO. : 7,184,681 B2
APPLICATION NO. : 10/928124
DATED : February 27, 2007
INVENTOR(S) : Funakoshi It is certified that error appears in the above-identified patent and that said Letters Patent is hereby corrected as shown below:

IN THE DRAWINGS:
Sheet No. 2, should be replaced with the attached drawing sheet.

COLUMN 1:
Line 6, "Jun. 23, 2003." should read --Jun. 23, 2003, now Pat. No. 6,836,628.--.

COLUMN 3:
Line 35, "image-on" should read --image on--.

Signed and Sealed this

Sixteenth Day of September, 2008

JON W. DUDAS
*Director of the United States Patent and Trademark Office*